US006645309B1

(12) United States Patent
Myers

(10) Patent No.: US 6,645,309 B1
(45) Date of Patent: Nov. 11, 2003

(54) METHOD OF USING WOBBLING BRUSH APPARATUS

(76) Inventor: Harold R. Myers, 4701 Chastant St., Metairie, LA (US) 70001

( * ) Notice: Subject to any disclaimer, the term of this patent is extended or adjusted under 35 U.S.C. 154(b) by 0 days.

(21) Appl. No.: 10/244,970

(22) Filed: Sep. 17, 2002

Related U.S. Application Data

(62) Division of application No. 10/021,711, filed on Dec. 12, 2001, now Pat. No. 6,449,792.

(51) Int. Cl.[7] ..... A47L 11/12; B08B 1/00; B60S 3/06

(52) U.S. Cl. ..... 134/6; 15/81.1; 15/22.1; 15/28; 15/53.4

(58) Field of Search ..... 134/6; 15/28, 21.1, 15/22.1, 53.4

(56) References Cited

U.S. PATENT DOCUMENTS 1,643,882 A 9/1927 Faiver
3,251,087 A 5/1966 Platt, Jr.
3,445,877 A 5/1969 Stout
4,467,489 A 8/1984 Begneaud
4,862,549 A 9/1989 Criswell et al.
5,224,237 A 7/1993 Ambrosiano
5,617,603 A 4/1997 Mei
6,138,317 A 10/2000 Holmes et al.
6,176,729 B1 1/2001 Myers
6,299,518 B1 10/2001 Daggett
6,449,792 B1 9/2002 Myers

*Primary Examiner*—Zeinab El-Arini
(74) *Attorney, Agent, or Firm*—Garvey, Smith, Nehrbass & Doody, LLC; Brett A. North

(57) ABSTRACT

Disclosed is a method of imparting a wobbling motion to a planar surface. In one embodiment the wobbling motion is imparted to a brush which can be used to clean uneven surfaces efficiently and easily. In another embodiment the wobbling motion is imparted to a brush which can be used to clean surfaces in confined spaces and reducing the risk of scratching or marring areas in the confined spaces. In another embodiment a method of cleaning a surface using a wobbling apparatus is disclosed.

17 Claims, 5 Drawing Sheets

METHOD OF USING WOBBLING BRUSH APPARATUS

CROSS-REFERENCE TO RELATED APPLICATIONS

This is a division of application Ser. No. 10/021,711, filed Dec. 12, 2001, now U.S. Pat. No. 6,449,792.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Brushes have been in existence as far back as 1500 B.C. when the Egyptians used crude brushes in painting tombs. Since that time up until today new and improved brushes have been developed and manufactured for numerous purposes including cleaning, dusting, painting, surface finishing, and others.

All kinds of surfaces exist requiring periodic or one time cleaning often facilitated by brush action and solvents. In most cases brushes are comprised of a one-piece handle or backing and fixed bristle requiring hand and arm action to accomplish the task. Powered radially operated brushes can also be used. Brushes can incorporate wire metal bristles, hair, synthetics, plant fiber, and other materials for bristles.

The majority of brushes require manual manipulation or can be electrically powered. Motor driven brushes have been used in manufacturing and repair operations as brushing teeth. These motor driven brushes have primarily rotating or reciprocating in motion.

Cleaning uneven surfaces with existing brushes, both manual and powered, can be laborious and inefficient.

Cleaning surfaces located in confined spaces can be problematic as the edge of the brush can nick or scratch parts of the object intended to be cleaned when brush is moved during the cleaning process.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment what is provided is an apparatus imparting a wobbling motion to a surface. Wobbling motion for a planar surface can be defined in relation to a longitudinal axis perpendicular to the surface. With reference to lines contained in the planer surface and intersecting the longitudinal axis, points found on any particular line and equidistant from the point of intersection with the longitudinal axis will have similar periods of oscillation but be substantially one hundred and eighty degrees out-of-phase. These equidistant points will also have substantially similar amplitudes of oscillation.

In a preferred embodiment a wobbling motion is imparted to a brush which can be used to clean uneven surfaces efficiently and easily.

In another preferred embodiment a wobbling motion is imparted to a brush which can be used to clean surfaces in confined spaces and reducing the risk of scratching or marring areas in the confined spaces.

In another embodiment wobbling motion imparted to a brush end permits rapid and efficient cleaning in sharp corners and recesses not easily obtained with other brushes.

In another embodiment a wobbling motion is imparted to a brush coupled with an orbiting action as desired by an operator of an external driver.

In another embodiment a brush is disclosed for cleaning surfaces whether flat, rough, irregular-shaped, or having deep cracks and crevices by imparting wobbling or orbital motion or a combination of more than one of these as the operator may choose.

In another embodiment a brush is disclosed that is faster, more efficient, and produces a cleaner surface than previous designs and types.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objectives, and advantages of the present invention, reference should be had to the following detailed description, read in conjunction with the following drawings, wherein like reference numerals denote like elements and wherein.

DETAILED DESCRIPTION OF A PREFERRED EMBODIMENT

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 2:
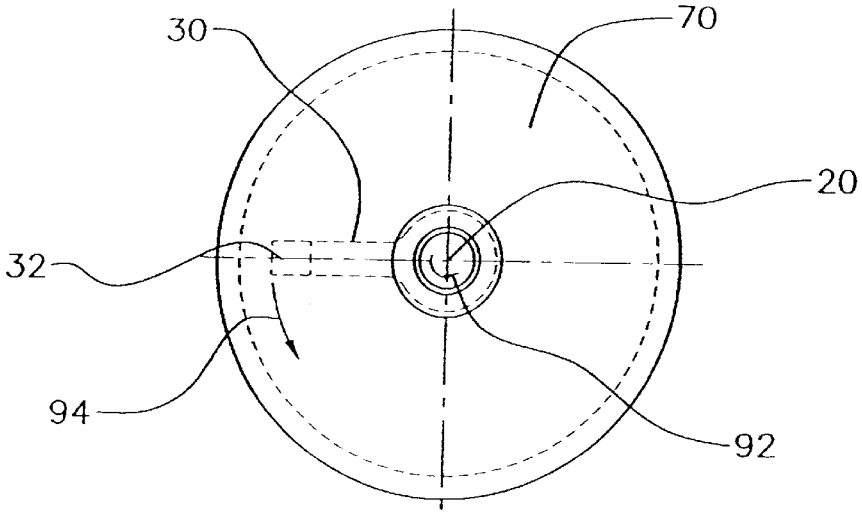
FIG. 2 is a top view of the apparatus in FIG. 1.
Figure 1:
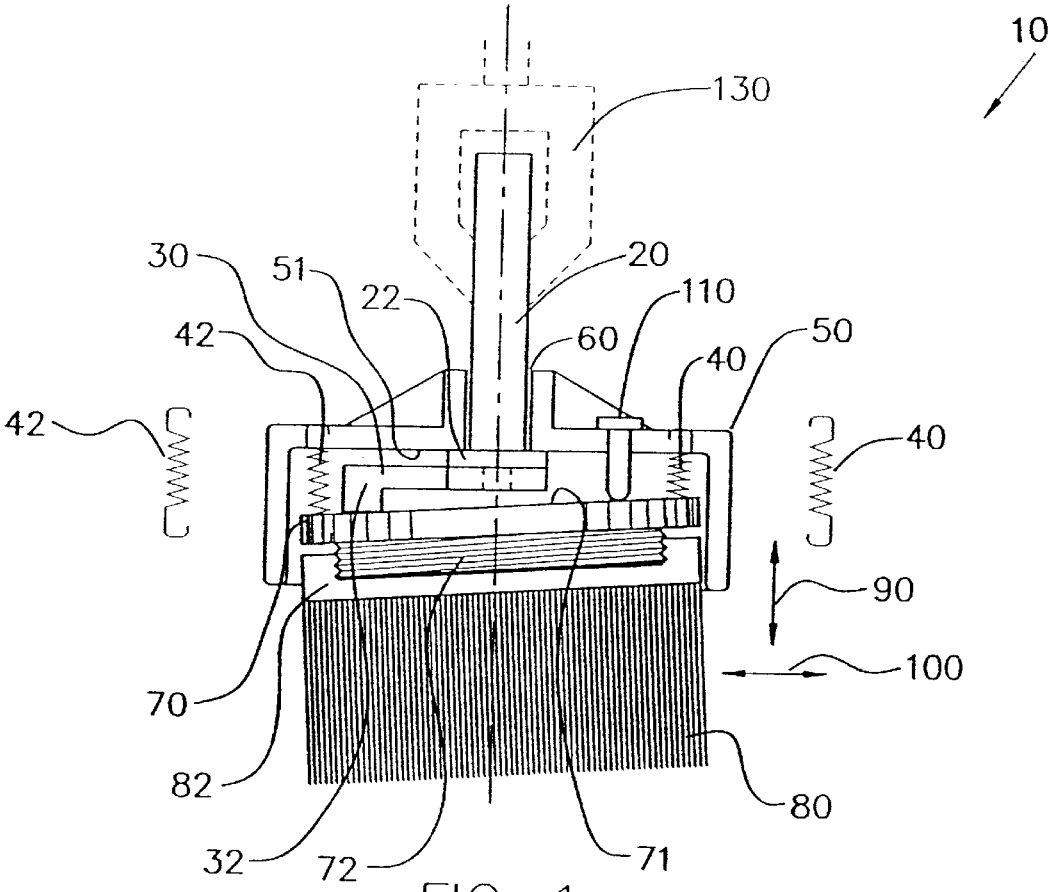
FIG. 1 is a cutaway side view of a preferred embodiment of the apparatus of the present invention.

FIG. 1 is a cutaway side view of a preferred embodiment of wobble apparatus 10 while FIG. 2 shows a top view of the apparatus in FIG. 1. Shaft 20 is connected to finger 30 which finger includes finger offset 32. One connection means includes a threaded bore in shaft 20 wherein a screw through bore 31 of attached finger 30, shown in FIGS. 5 and 6. Shaft 20 is inserted into casing or base 50 through bore 60. Collar 22 prevents shaft 20 from being pulled through bore 60. Shown in hidden lines is driver 130 which is operatively connected to shaft 20 rotating said shaft.

Float 70 is elastically connected to casing or base 50 by one or more elastic units 40, preferably at least three of said units. Elastic units 40 can be springs, elastic bushings, elastomers, or other conventional items having a sufficient elasticity. A variety of connection means can be used for attaching elastic units 40, such as spring end clips. Mechanical fasteners such as screws can also be used along with conventional adhesives. It is preferable that a connection means be used facilitating easy installation and removal of the one or more elastic units 40.

One or more elastic units 40 elastically connect float 70 to surface 51 of casing or base 50. Rotation of shaft 20 in the direction of arrow 92 causes rotation of finger 30 and finger offset 32 in the direction of arrow 94. At any one point in time finger offset 32 pushes on rear surface 71 of float 70 thereby causing localized movement of float 70 away from surface 51 and longitudinal expansion in the direction of arrow 90 of the elastic unit 42 which is temporally closest to the transient position of finger offset 32. Some movement of elastic unit 42 in the direction of arrow 100 may also be seen. Also at any one point in time the portion of rear surface 71 located angularly opposite finger offset 32 will be moved toward to rear surface 51.

As finger offset 32 rotates in the direction of arrow 94 away from elastic unit 42, elastic unit 42 will contract in the direction of arrow 90 thereby bringing the portion of rear surface 71 adjacent elastic unit 42 closer to surface 51. Some movement of elastic unit 42 in the direction of arrow 100 may also be seen. Further rotation in the direction of arrow 94 of finger offset 32 will also cause longitudinal expansion in the direction of arrow 90 of another elastic unit 40. Some movement of the another elastic unit 40 in the direction of arrow 100 may also be seen.

The process of relative expansion and contraction for the one or more elastic units 40, 42 will continue through each complete revolution of finger offset 32. At any point in time the portion of rear surface 71 in contact with finger offset 32 will be pushed away from surface 51 while the point located angularly opposite said contact point will be pulled toward surface 51. Such specific relative movement in the directions of arrows 90 and 100 yields an overall wobbling movement of float 70. The amount of travel of float 70 is controlled by the design of finger offset 32 and finger 30. The frequency of oscillations is controlled by the rotational speed of shaft 20.

Brush 80 includes brush head 82 and is operatively connected to float 70 through interlocking threads 72. However, various other connection means can be used such as mechanical interlocking, snap ring, compression clamp, magnetic, welding, or adhesives. The wobbling movement of float 70 will be transferred to brush 80 and such movement can be used to clean surfaces allowing the brush ends to move in an out with slight side-to-side motion into cracks and crevices as finger offset 32 rotates. The stiffness and texture as well as diameter and length of the brush bristles depend on the particular applications desired. The ends of the bristles may have different configurations as well as size and stiffness, thereby improving the effectiveness of cleaning. Brush 80 is preferably designed so that replacement brushes can be installed without replacing entire wobble apparatus 10.

If no resistance to rotation is provided, such as in free air, frictional forces will resist relative movement between finger offset 32 and float 70, and float 70 will tend to rotate with shaft 20. However, when rotational resistance is provided, such as when brush 80 is in contact with a surface to be cleaned, the interference between the two will resist rotation of float 70 allowing relative movement between finger offset 32 and float 70 and causing a wobbling motion of brush 80. Additional resistance to rotation can be achieved by gripping casing or base 50.

Figure 3:
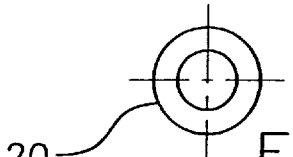
FIG. 3 is a top view of a shaft.
Figure 4:
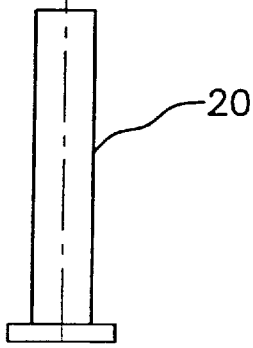
FIG. 4 is a side view of a shaft.
Figure 5:
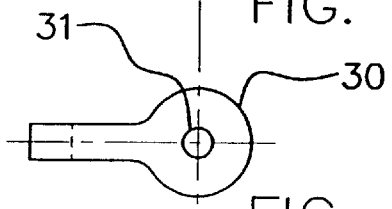
FIG. 5 is a top view of a finger.
Figure 6:
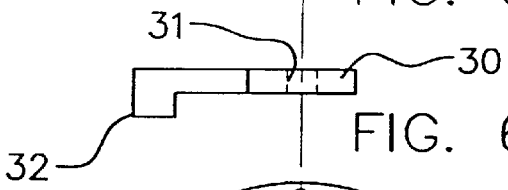
FIG. 6 is a side view of a finger.
Figure 7:
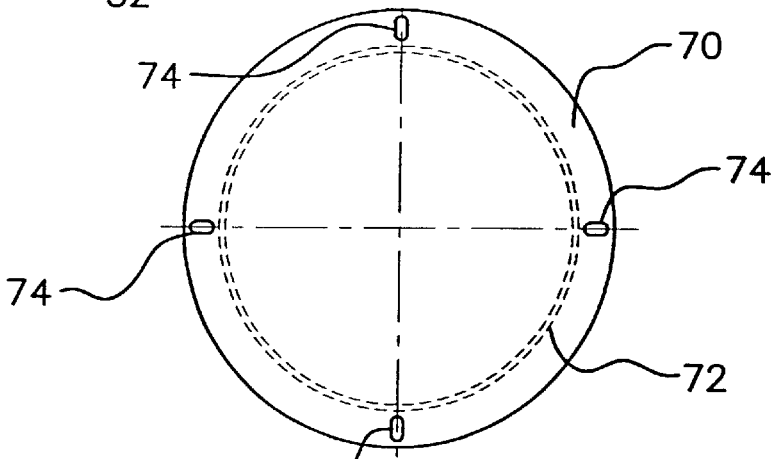
FIG. 7 is a top view of a float.
Figure 8:
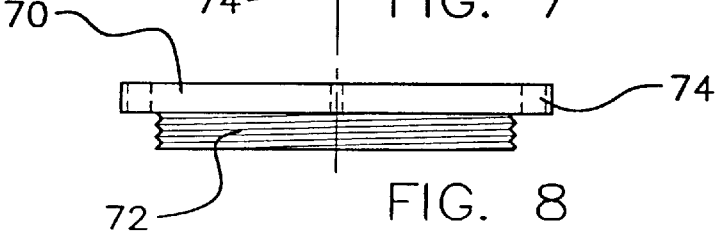
FIG. 8 is a side view of a float.
Figure 9:
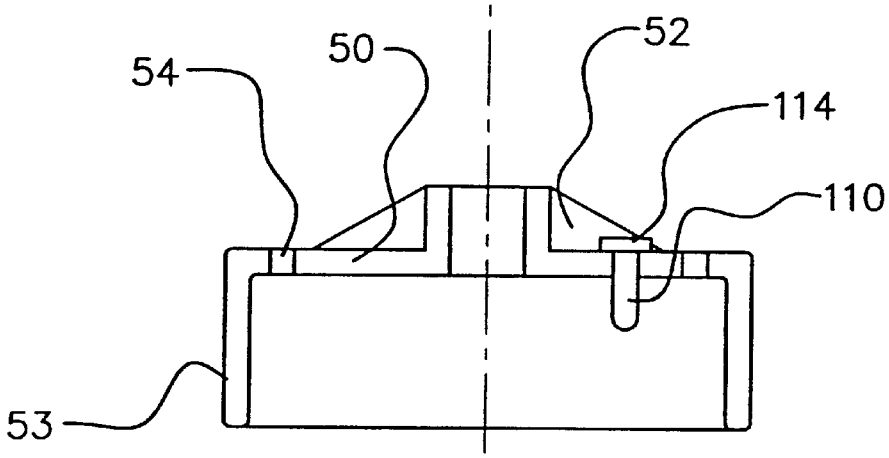
FIG. 9 is a cutaway side view of a casing or base.

An alternative embodiment includes pin 110 being inserted into casing or base 50. During rotation in the direction of arrow 94 finger 30 will eventually contact pin 110 causing casing or base 50 to now rotate with finger 30. In this embodiment wobbling movement has been substantially reduced and brush 80 is practically converted into a rotating brush. However, there can still be some movement of float 70 in the directions of arrows 90 and 100 depending on the forces applied on the one or more elastic units 40, 42 by brushing activity. Such forces can cause relative expansion and contraction thereby causing movement in the directions of arrows 90 and 100. FIGS. 3–9 include views for various parts shown in FIG. 1. FIGS. 3 and 4 are respectively top and side views of shaft 20. FIGS. 5 and 6 are respectively top and side views of finger 30. Bore 31 is also shown in FIGS. 5 and 6. FIGS. 8 and 9 are respectively top and side views of float 70. Four holes 74 are shown in FIG. 7 which can be used to attach four elastic units 40, 42. Threads 72 are shown as the attachment means for brush 80.

Figure 10:
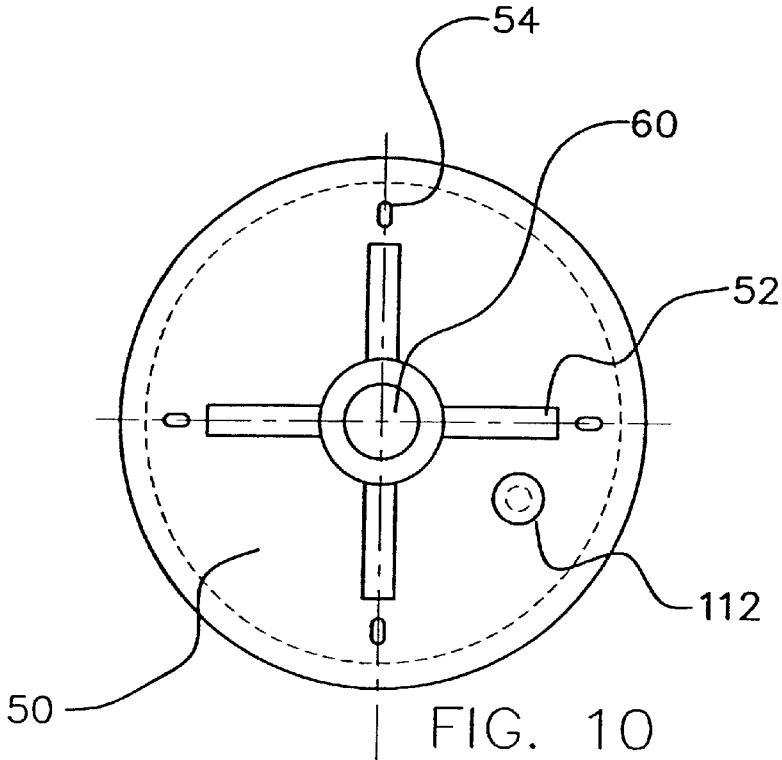
FIG. 10 is a top view of a casing or base.

An alternative embodiment includes a plurality of spacers 55 projecting from surface 51 of casing 50. Spacers 55 can be positioned such that float 70 maintains a minimum distance from surface 51 and one or more elastic units 40, 42 are held in at least a specified minimum tensile state which can help maintain a mechanical connection between the elastic units and casing 50. FIG. 9 is a cutaway side view of casing or base 50 and FIG. 10 is a top view. Four holes 54 are shown in FIG. 10 which can be used to attach four elastic units 40, 42. Braces 52 can be included for increased strength. Guard piece 53 can also be included for safety concerns. Guard piece 53 can be mechanically attached to casing or base 50 or can include slots for access to one or more elastic members 40, 42. Pin 110 is shown with head 114.

Figure 12:
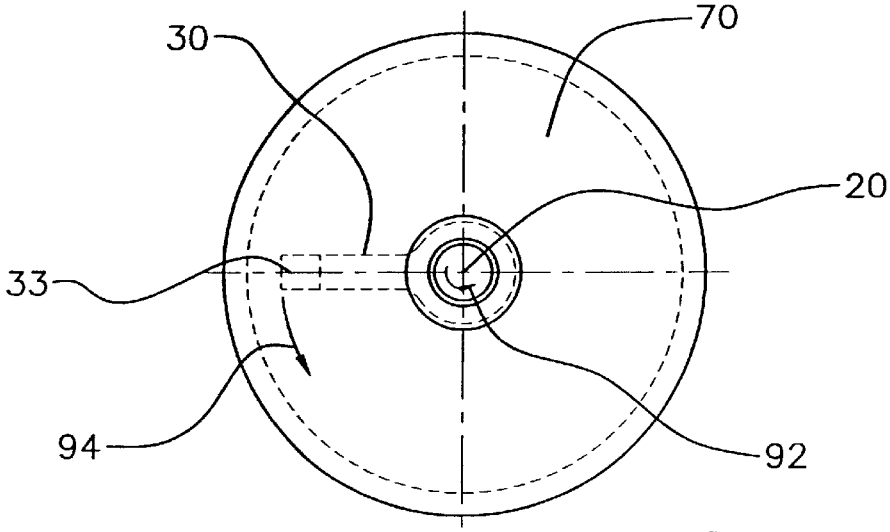
FIG. 12 is a top view of the apparatus in FIG. 11.
Figure 11:
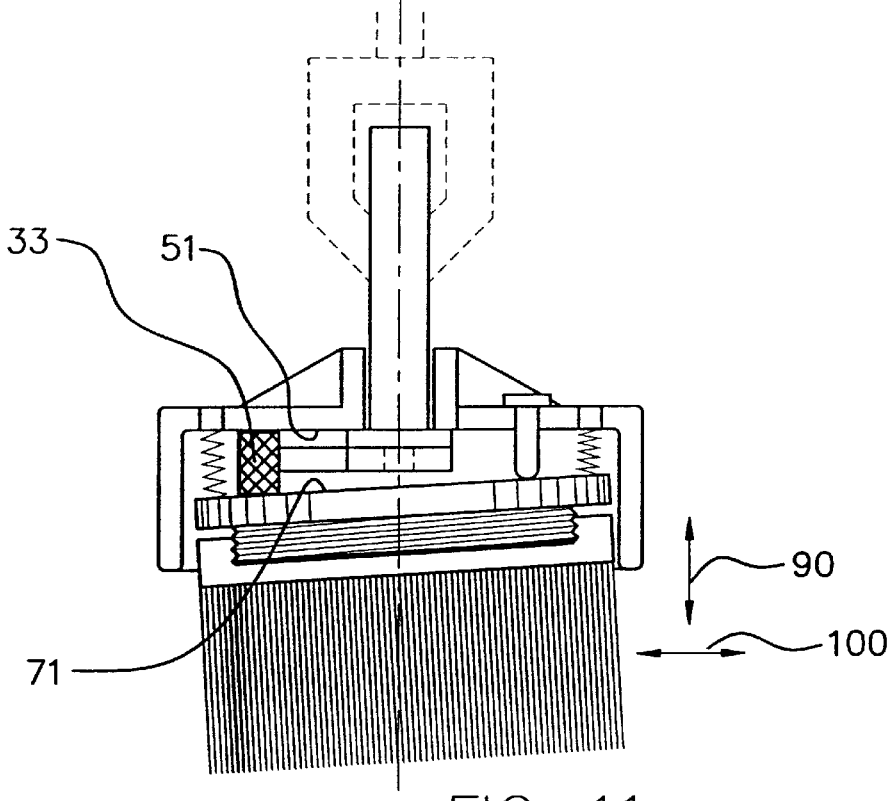
FIG. 11 is a cutaway side view of an alternative embodiment of the apparatus of the present invention.

FIG. 11 is a cutaway side view of an alternative embodiment of the apparatus of the present invention and FIG. 12 is a top view. In this alternative embodiment rotatable offset 33, such as a roller, replaces offset 32. Rotatable offset 33 can reduce friction during rotation of finger 30 in the direction of arrow 94. Rotatable offset 33 spins on rear surface 71 during rotation in the direction of arrow 94. At least a small gap should exist between rotatable offset 33 and surface 51 to minimize frictional losses.

Figure 14:
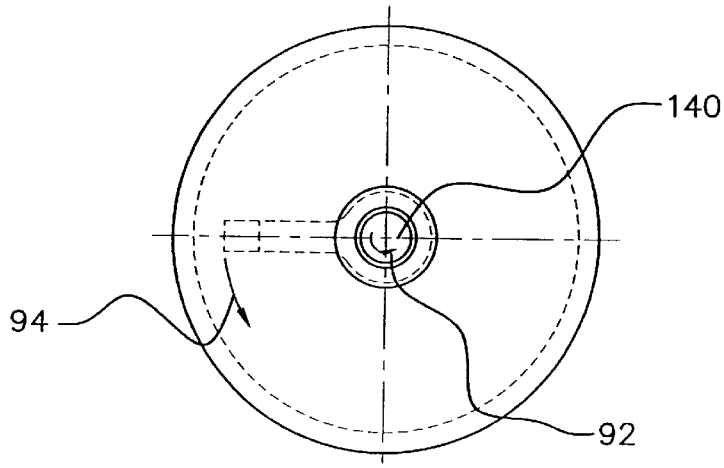
FIG. 14 is a top view of the apparatus in FIG. 13.
Figure 13:
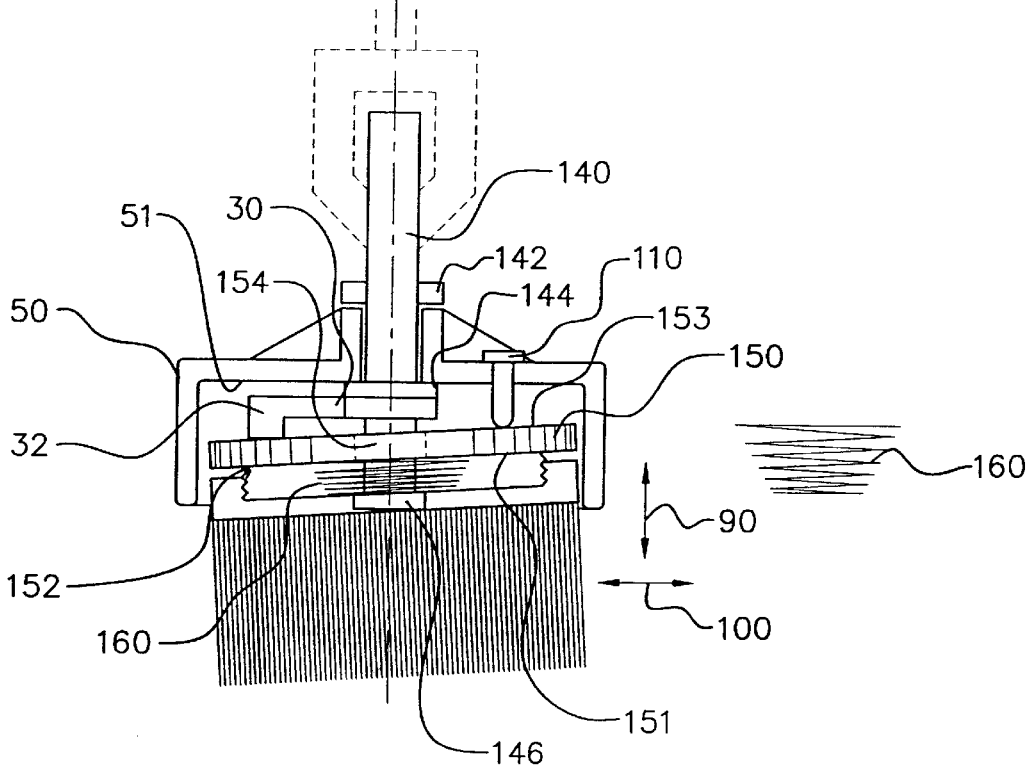
FIG. 13 is a cutaway side view of another alternative embodiment of the apparatus of the present invention.

FIG. 13 is a cutaway side view of another alternative embodiment of the apparatus of the present invention and FIG. 14 is a top view. In this embodiment float 150 is elastically attached to shaft 140 instead of casing or base 50. Collars 142 and 144 can be used to restrict longitudinal movement between shaft 140 and casing or base 50. Shaft 140 extends through enlarged bore 154 of float 150 which bore is sized to allow relative angular movement between the shaft and float.

Float 150 is elastically connected to shaft 140 by one or more elastic units 160, preferably one unit. Elastic unit 160 can be springs, elastic bushings, elastomers, or other conventional items which have a sufficient elasticity. A single elastic unit 160, can be mounted between collar 146 and float 150. However, a variety of connection means can be used for mounting one or more elastic units 160, such as conventional mechanical fasteners including screws or conventional adhesives. It is preferable that the mounting means used facilitates easy installation and removal of the one or more elastic units 160 for maintenance purposes.

One or more elastic units 160 elastically connect float 150 to shaft 140. Rotation of shaft 140 in the direction of arrow 94 causes rotation of finger 30 and finger offset 32. At any one point in time finger offset 32 pushes on rear surface 153 of float 150 causing localized movement of float 150 away from surface 51 and at least a partial contraction of elastic member 160 in the direction of arrow 90 which is temporally closest to finger offset 32. Also at any one point in time the portion of rear surface 153 located angularly opposite finger offset 32 will be moved toward to surface 51.

As finger offset 32 rotates in the direction of arrow 94 a different portion of rear surface 153 will be pushed away from surface 51 in the direction of arrow 90. This process of differential movement of float 150 will continue through each complete revolution of finger offset 32 yielding wobbling movement of float 150. Pin 110 can also be included to convert the movement to substantially orbital.

An alternative embodiment includes a plurality of spacers 55 projecting from surface 51 of casing 50. Spacers 55 can be positioned such that float 150 maintains a minimum distance from surface 51 and one or more elastic units 160 are held in at least a specified minimum compressive state which can help maintain a mechanical connection between the elastic units and float 150.

Examples of items to be cleaned with a wobbling brush apparatus include automobile wheels, hubcaps, machine parts, and similar areas, which can be difficult to clean using ordinary brushes. The time to clean is much faster as the brush will reach into sharp corners where standard round brushes will not reach effectively.

LIST FOR REFERENCE NUMERALS

| (Part No.) | (Description) |
|---|---|
| 10 | wobble apparatus |
| 20 | shaft |
| 22 | collar |
| 30 | finger |
| 31 | bore |
| 32 | offset |
| 33 | rotatable offset |
| 40 | elastic unit |
| 42 | elastic unit |
| 50 | casing or base |
| 51 | surface |
| 52 | brace |
| 53 | guard |
| 54 | hole |
| 55 | spacers |
| 60 | bore |
| 70 | float |
| 71 | rear surface |
| 72 | threads |
| 74 | hole |
| 80 | brush |
| 82 | head |
| 90 | arrow |
| 92 | arrow |
| 94 | arrow |

-continued

LIST FOR REFERENCE NUMERALS

| (Part No.) | (Description) |
|---|---|
| 100 | arrow |
| 110 | pin |
| 112 | inlet |
| 114 | head |
| 130 | driver |
| 140 | shaft |
| 142 | collar |
| 144 | collar |
| 146 | collar |
| 150 | float |
| 151 | front surface |
| 152 | chamber wall |
| 153 | rear surface |
| 154 | bore |
| 160 | elastic unit |

Materials of construction include plastics, rubbers, polymers, elastomers, metals or combinations of these. Additionally, the bristles may be of a multitude of materials commonly used for cleaning or abrasion.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A method of cleaning a surface using a wobbling apparatus, the method comprising the steps of:

(a) contacting a surface to be cleaned with a wobbling apparatus, the wobbling apparatus having a brush and an input for a rotational movement of the brush;

(b) applying rotational force to the input for the wobbling apparatus;

(c) the rotational force causing a wobbling movement of the brush; and (d) cleaning the surface with the wobbling movement of the brush.

2. The method of claim 1, further comprising a step of causing the movement of the brush to switch from wobbling to an orbital movement.

3. A method of cleaning a surface comprising the steps of (a) contacting the surface with a wobbling apparatus, the wobbling apparatus comprising:

(i) a base;

(ii) a shaft rotatably engaged with the base, the shaft having a longitudinal axis;

(iii) a float elastically connected to the base and a brush connected to the float;

(iv) a finger positioned between the base and the float and having first and second ends, wherein the first end is operably connected to the shaft and the second end engages the float; and (v) the second end being at a distinct relative position in a direction parallel to the longitudinal axis of the shaft; and (b) causing rotational movement of the finger across the float thereby causing at least partial elastic offsetting of the float and brush from the base, the partial elastic offsetting of the brush cleaning the surface.

4. The method of claim 3, wherein in step "a," the second end of the finger includes a roller which rotatably engages the float.

5. The method of claim 3, wherein in step "a," the wobbling apparatus further comprising a pin slidably engaging the finger and base.

6. The method of claim 3, wherein in step "a," the wobbling apparatus further comprising a guard attached to the base and at least partially encasing the float.

7. The method of claim 3, wherein in step "a," at least three elastic members connect the float to the base.

8. The method of claim 7, wherein in step "a," the elastic members are springs.

9. A method of cleaning a surface using a wobbling apparatus, said method comprising the steps of:

(a) contacting the surface to be cleaned with a wobbling apparatus, the wobbling apparatus having an input and an output;

(b) applying a force to the input; and (c) the force causing a wobbling motion of the output, the wobbling motion of the output cleaning the surface.

10. The method of claim 9, wherein in step "a," the wobbling apparatus further comprises a float connected to the output.

11. The method of claim 10, wherein in step "a," the float is elastically connected.

12. The method of claim 11, wherein in step "a," the float is elastically connected by a plurality of springs.

13. The method of claim 11, wherein in step "a," the float is elastically connected by at least one elastomer member.

14. The method of claim 10, wherein in step "a," the wobbling apparatus further comprising a brush connected to the float.

15. The method of claim 9, wherein in step "b," the force applied to the input is a rotational force.

16. The method of claim 15, further comprising the step of causing an orbital motion of the output.

17. The method of claim 15, wherein in step "a," the wobbling apparatus further comprising a brush connected to the output.

* * * * *